United States Patent [19]

Toti

[11] Patent Number: 4,499,938

[45] Date of Patent: Feb. 19, 1985

[54] PATTERNED METAL BLIND SLAT AND METHOD AND APPARATUS FOR PRODUCING THE SAME

[76] Inventor: Andrew J. Toti, 311 W. River Rd., Modesto, Calif. 95351

[21] Appl. No.: 457,682

[22] Filed: Jan. 13, 1983

[51] Int. Cl.[3] ..... B21D 53/00

[52] U.S. Cl. ..... 160/236; 72/177; 72/187; 72/379

[58] Field of Search ..... 160/166 R, 166 A, 173, 160/177, 178 R, 236, 352; 72/177, 187, 196, 72/327, 379; D6/205, 208.1

[56] References Cited

U.S. PATENT DOCUMENTS

| | | | |
|---|---|---|---|
| 2,103,788 | 12/1937 | Mohrfeld | 160/236 |
| 2,567,256 | 9/1951 | Toti et al. | 160/236 |
| 3,168,028 | 2/1965 | Booth et al. | 160/236 |

FOREIGN PATENT DOCUMENTS

| | | | |
|---|---|---|---|
| 250732 | 12/1962 | Australia | 160/178 R |
| 87580 | 7/1959 | Denmark | 160/236 |

*Primary Examiner*—Lowell A. Larson
*Attorney, Agent, or Firm*—Flehr, Hohbach, Test, Albritton & Herbert

[57] ABSTRACT

A metal slat for use in a venetian-type blind including an embossed rib formed at each narrowed slat material region adjacent the cord receiving slots. The slat also includes a decorative weave pattern comprising a plurality of separated longitudinal rows of embossed ribs formed on the slat in a continuous in-and-out pattern.

Also disclosed is apparatus for forming the embossment weave pattern concurrent with forming the crown configuration of the slat. The apparatus includes a first rotary die arrangement for prestretching of at least one localized region of a continuous flat metal strip passing therethrough, a second rotary die arrangement for simultaneously forming the strip into a crown configuration and forming the embossment pattern therein, and a third die arrangement for compensating out of the strip any bow, side curve or twist.

30 Claims, 21 Drawing Figures

PATTERNED METAL BLIND SLAT AND METHOD AND APPARATUS FOR PRODUCING THE SAME

This invention relates generally to metal blind slats and metal working and forming apparatus and methods for producing metal blind slats. More specifically, this invention relates to a metal blind slat having a decorative embossment rib pattern formed therein as well as other slat-strengthening embossment ribs. This invention also relates to methods and apparatus for producing a crown configuration and embossment pattern on a thin metal slat.

Metal blinds of both the venetian type (horizontal blind slats) and vertical blind systems have been popular window treatments for a number of years. The use of horizonally disposed venetian type blinds has involved several problems and limitations which detract from the quality and durability of the product. One of the problems that has troubled the venetian blind industry for a number of years is the weakening of the crowned venetian blind slat at the point where a cord receiving slot is punched therethrough. This weakened location in the slat can easily be bent to a permanent set, producing what has been called a "dog ear" distortion in the slat.

In addition, the venetian blind industry has had difficulty with stability of the venetian blind slat. It is desirable that the slat be flexible enough to bend but also stable and rigid enough to spring back to its original shape without taking a permanent bend when flexed out of its straight position. The use of a relatively springy hard metal strip and the forming of that hard metal strip into a crowned configuration assists in providing stability with flexibility, but problems of permanent slat distortion still continue to trouble the industry.

Attempts have been made to strengthen venetian blind slats by longitudinal corrugation such as is taught in Pomeroy U.S. Pat. No. 3,344,641. However, although longitudinal corrugation increases the stability of the slat, it also substantially reduces the flexibility of the slat. In addition, although longitudinal corrugation as shown in the Pomeroy '641 patent imparts a small amount of pattern to the slat, the industry has not succeeded to date in providing a venetian blind slat or vertical blind slat with a decorative weave pattern which is sufficiently outstanding from a visual standpoint that a somewhat cloth-like appearance is achieved for closed blinds when viewed from a moderate distance.

One of the reasons that the industry has not succeeded in simultaneously improving the stability of blind slats and improving their decorative appearance with embossment patterns thereon is that it is difficult to control the quality of the slat through the simple crown forming process that is the standard operation in today's venetian blind industry. Modern venetian blinds and vertical blinds are usually made up of lengths of thin sheet metal strips having a thickness for example in the range of about 0.008–0.010 inch. The most popular blind on the market today is the mini-blind having a width of about 1 to 1½ inches since it gives a more delicate window treatment appearance. Venetian blind slats are formed from flat continuous rolls of thin sheet metal to pass through forming rolls and then delivered to a cut-off table for formation of the cord receiving slots and to cut the slat to length. The continuous thin sheet metal strip received from the mill includes inherent distortions which can cause the final slat to exhibit a side curve, a bow, and/or a twist. All of these distortion conditions result in a slat which is unacceptable. The blind industry has worked for years to perfect approaches to removing distortions from crowned slats with only partial success. Mattie U.S. Pat. No. 4,145,905 discloses one approach to a method and apparatus for correcting bow and camber (side curve). While units such as the one disclosed in the Mattie '905 patent improve the ability to control the quality of the venetian blind slat, problems with achieving quality on a consistent basis are still present in current manufacturing methods.

It is well-known that attempts to form decorative embossment patterns on thin metal strips accentuate the problems of controlling the quality of the strip from the standpoint of keeping side curve, bow and twist out of the resultant slats. Forming a decorative embossment pattern on a thin venetian blind slat is even more difficult due to the necessity of providing a crowned configuration in the slat to achieve the basic stability required. Relatively deep embossment patterns are required for truly decorative appearance of the venetian blind slat and problems of controlling distortion are substantially increased when relatively deep embossment is performed. Quality control problems are increased if the metal strip is painted since it is extremely difficult to form a deep embossment pattern in a painted strip without marring the paint.

My earlier U.S. Pat. No. 4,362,039 discloses a method and apparatus for forming a decorative weave pattern in a straight metal strip which is subsequently shaped with longitudinal corrugations to increase the strength and stability of the strip. The decorative weave pattern formed on the strip in the apparatus of the Toti '039 patent involves a horizontal weave pattern in which transverse slits are actually cut in the strip in the deep center weave regions thereof. While such cutting of the strip is believed acceptable in the metal drape art which is the principal application of the methods and apparatus disclosed in the Toti '039 patent, such marring of the strip and cutting thereof is not acceptable in venetian blind slats. Moreover, the slats which are utilized in foldable metal drapes as disclosed in the Toti '039 patent are generally about 1¾ to 2 inches wide and problems of slat distortion are not as severe since the weave pattern is formed prior to any corrugation of the cross-sectional configuration of the strip.

Accordingly, further advances in the metal patterning art are required in order to produce a decorative metal slat for horizontal venetian blinds and vertical blind systems while eliminating all problems with strip distortion and paint marring.

It is an object of this invention to provide an improved metal venetian blind slat.

It is a further object of this invention to provide a venetian blind slat with improved rigidity at the cord receiving slot portion of the slat.

It is a further object of this invention to provide a venetian blind slat which substantially eliminates the dog ear problem in such slats.

It is another object of this invention to provide a venetian blind slat which has a decorative weave pattern appearance without marring the quality of the slat from a shape and appearance standpoint.

It is a further object of this invention to provide apparatus for efficiently and effectively forming a decorative weave pattern in a crowned metal slat.

It is another object of this invention to provide an improved method for producing a crowned and patterned metal slat for use in venetian type and vertical blind slat systems.

One aspect of this invention features a metal slat for use in a venetian type blind and having a pair of cord receiving transverse slots formed therethrough at respective end sections thereof with each of the slots defining a narrowed slat material region between each end of the slot and an associated adjacent marginal edge of the slat. The invention comprises the improvement of an embossed rib formed in the slat at each of the narrowed slat material regions with each of the ribs extending longitudinally on the slat and having an overall length substantially greater than the width of the slot.

Another aspect of this invention features a metal slat for use in one of a venetian type blind system with horizontally disposed slats or a vertical slat blind system wherein the improvement comprises a plurality of separated longitudinal rows of embossed ribs formed on the slat in a continuous in-and-out pattern of successive ribs in each row and having a substantial depth relative to the thickness of the slat. Preferably the individual in-and-out patterns of embossed ribs in adjacent rows are offset longitudinally to a substantial degree to impart additional rigidity to the slat without impairing flexibility thereof. For appearance sake it is preferable that the individual in-and-out patterns be offset substantially one-half the length of the individual ribs.

Another aspect of this invention features apparatus for forming an embossment pattern and crown configuration on a thin narrow strip of relatively hard material with the embossment pattern comprising a plurality of separated longitudinal rows of embossed ribs formed on the slat in a continuous in-and-out pattern of successive adjacent ribs in each row. The apparatus includes a first rotary die means for prestretching of at least one localized region of a continuous flat metal strip passing therethrough and a second rotary die arrangement receiving the metal strip from the first rotary die arrangement for simultaneously forming the strip into a crowned configuration and forming the embossment pattern therein. Preferably the apparatus further includes a compensating die arrangement which receives the crowned and embossed strip from the second rotary die arrangement and removes any upward or downward bow detected in the strip, any right or left side curve detected in the strip, and any detected twist in the strip.

The compensating die arrangement preferably includes a bow and side curve compensating die which receives the crowned and embossed strip from the second rotary die arrangement and includes positioning means for controlling both the vertical and horizontal orientation of the path of the strip exiting the second rotary die means to remove any bow or side curve detected in the strip. A second twist compensating die means receives the strip from the bow and side curve compensating die arrangement to apply a controlled degree of twist to the strip to remove any detected twist therein.

Another aspect of this invention features a machine for forming a slat for use in venetian type blinds and having a pair of cord receiving transverse slots formed therein at respective end sections thereof with the slots defining narrowed slat material regions between each end of each of the slots and an associated adjacent marginal edge of the slat. The slat further has an embossed rib formed therein at each of the narrowed slat material regions and a plurality of separated longitudinal rows of embossed ribs formed in a continuous in-and-out pattern of successive ribs in each row. The machine includes a first machine stage for forming the embossment pattern and crowned configuration on a continuous strip of metal and a second machine stage for receiving the patterned and crowned strip for forming the slots and adjacent ribs therein and cutting the continuous strip into prearranged slat lengths and an interface stage for controllably feeding the patterned and crowned strip from the first machine stage into the second machine stage.

The first machine stage includes a first rotary die means for prestretching of at least one localized region of a continuous flat metal strip passing therethrough. A second rotary die arrangement receives the metal strip from the first rotary die arrangement and simultaneously forms a strip into a crowned configuration and forms the embossment pattern thereon. This second rotary die arrangement includes drive means powering the second rotary die means to pull the metal strip through the first rotary die arrangement. A third die arrangement receives the crowned and embossed strip from the second rotary die arrangement for removing detected bow, side curve or twist in the crowned and embossed strip. The crowned and embossed strip is pushed through the third die arrangement by the driven second rotary die arrangement.

The second machine stage includes a pair of punch die arrangement, each of which includes a male and female die element for simultaneously forming one of the slots in the strip and the embossed ribs associated therewith.

Another aspect of this invention features a method for producing a crowned and patterned metal slat which includes passing a continuous strip of metal from a supply roll successively through a pair of rotary die stations and a compensating die station. The method further includes forming at a first one of the rotary die stations a controlled prestretching of at least one central portion of the strip of metal. The method next involves simultaneously forming at a second one of the rotary die stations a crowned cross-sectional configuration in the strip and a plurality of separated longitudinal rows of embossed ribs having an in-and-out pattern of successive ribs. Following that is performed the step of compensating any detected side curve, bow or twist out of the crowned and embossed strip at the compensating die station.

The patterned metal blind slat of this invention, and the apparatus and method for producing the same, provide several important advantages over prior art slats and slat production techniques. The provision of a pair of embossed ribs at the end of the cord receiving slots utilized on venetian type blind slats substantially strengthens the slat in this narrowed material region and substantially inhibits sharp bending of the slat at that location in a way which would produce a permanent deformation (i.e the dog ear problem of the prior art slats). The formation of such embossed longitudinal ribs can readily be performed at the same die station which punches the slot in the strip. Thus this substantial improvement is achieved at virtually no increase in slat production cost. While this advantageous feature is preferably combined with the use of a patterned metal blind strip for venetian type blinds, it can also be utilized on unpatterned venetian blind slats to similar advantage.

The provision of a patterned venetian blind slat in accordance with this invention has the advantage of not only enhancing the visual appearance of the slat by giving it a textured or woven material look, but it also substantially increasing the stability of the slat while at the same time maintaining the requisite slat flexibility. The in-and-out pattern of longitudinal rows of embossments on the slat are formed without marring the paint. By offsetting the respective in-and-out patterns in adjacent rows the embossment pattern adds strength to the slat. Greater force is required to bend the slat to a permanent deformation. The apparatus of this invention has the advantage of enabling the production of a decorative embossment pattern on a thin metal slat of relatively hard material with good production yield. A relatively small and compact machine with only three die stations is all that is required to form the decorative embossment pattern. Because of the overall design of the die stations and integration of their functions in accordance with the principles of this invention, good quality control over the final patterned slat characteristics is achieved. Deeply embossed slats can be formed in continuous strip material which is only about an inch in width and with virtually perfect control over slat quality, i.e. consistent production of straight slats without bow, side curve or twist. The apparatus is capable of operation at strip speeds of 70 to 150 feet per minute and can thus keep up with current slat production speeds.

An additional advantage is the ease with which the patterning and crown forming apparatus of this invention can be integrated with a slat cut-off machine which may include die stages for forming slots in the individual slats for venetian type blinds. This integration of two machine stages with an interface stage which controls the supply of the patterned and crowned strip to the cut-off machine enables an attractively patterned blind slat to be produced for substantially the same cost as unpatterned blind slats. Thus the decorative and functional advantages of the patterned slat are achieved without any substantial increase in manufacturing cost.

Other objects, features and advantages of this invention will be apparent from a consideration of the following detailed description taken in conjunction with the accompanying drawings.

Figure 1:
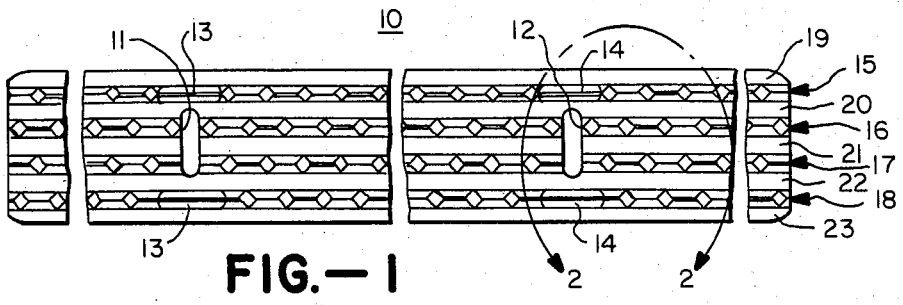
FIG. 1 is a top plan view of a patterned venetian blind slat in accordance with this invention.
Figure 2:
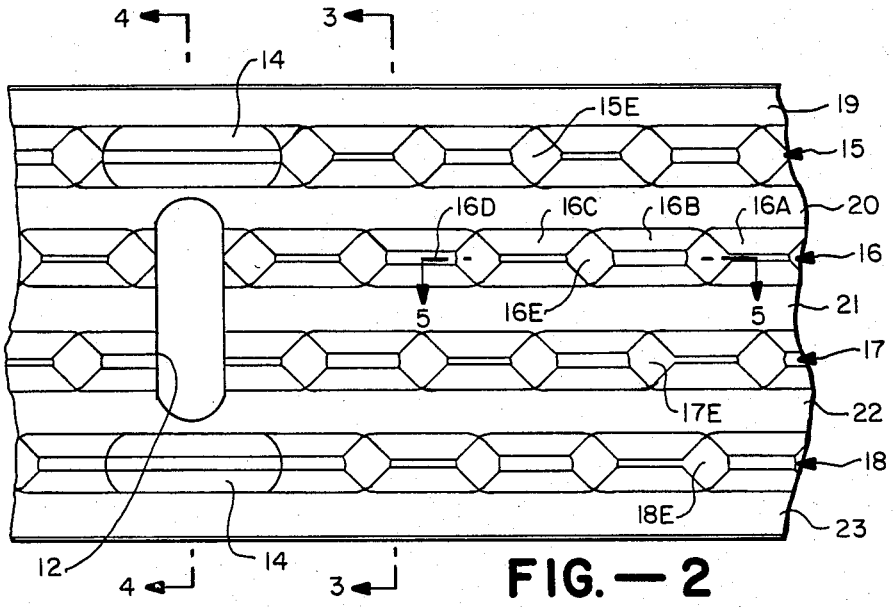
FIG. 2 is an enlarged fragmented plan view showing the details of the preferred embossed rib pattern for a metal blind slat in accordance with this invention.
Figure 3:
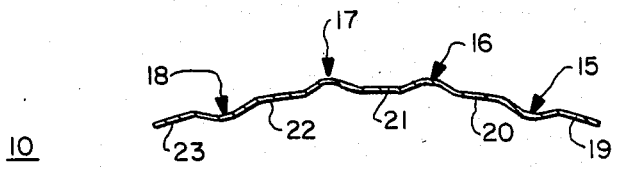
FIG. 3 is an enlarged section view of a patterned metal blind slat taken along the line 3—3 in FIG. 2.
Figure 4:
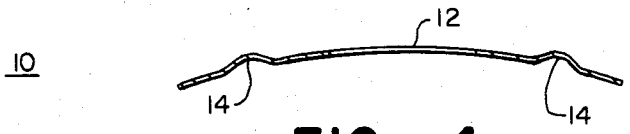
FIG. 4 is an enlarged section view of a patterned metal blind slat taken along the line 4—4 in FIG. 2.
Figure 5:
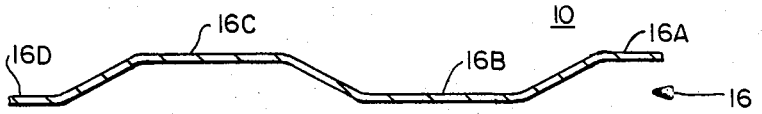
FIG. 5 is an enlarged partial section view taken along the line 5—5 in FIG. 2.

Referring now to FIGS. 1–5, an embodiment of a patterned metal blind slat in accordance with this invention will be described. The particular form of metal blind slat 10 depicted in FIG. 1 is a venetian blind slat having a pair of cord receiving slots 11 and 12 formed in right and left end sections thereof. A pair of embossed longitudinal ribs 13 are provided in the slat adjacent the slot 11 formed therein. A pair of embossed longitudinal ribs 14 are formed in the slat adjacent the slot 12 at the other end of the slat. The relatively deeply embossed ribs 13 and 14 are shown in cross-section in FIG. 4. These ribs serve to substantially strengthen the slat in the region of the slot to impede permanent bending of the slat at that location. This feature is shown in FIGS. 1 and 2 as being used on a patterned metal blind slat, but it will be appreciated that this feature could also be utilized on unpatterned slats with the same advantage.

A patterned blind slat in accordance with this invention is shown in FIG. 1 in the form of a one inch mini-blind slat having four separated longitudinal rows 15–18 of embossed ribs formed thereon in a continuous in-and-out pattern of successive ribs. Each of the rows 15–18 of embossed ribs is formed between adjacent flat sections 19–23. This represents the preferred form of embossment pattern on a mini-blind slat. It will be appreciated that other patterns could be utilized but it is preferable to have a pattern which has a neutral unpatterned area at the center of the slat and longitudinal rows of embossed ribs symmetrically positioned on the slat. Slats of greater width may utilize additional rows of embossed ribs.

The embossed rib pattern shown in FIG. 1 also represents the preferred width and periodicity of the in-and-out pattern of successive ribs, i.e. a rib length of about 0.25 inch and a width of about one-eighth inch. While the width and length of successive ribs is not critical, it has been found that the use of substantially longer individual ribs would impact too much rigidity to the slat while the use of substantially shorter ribs does not materially improve the stability of the slat. As depicted in FIG. 1, the preferred relative positioning of the in-and-out embossment pattern in successive rows involves a longitudinal offset of the rib pattern in successive adjacent rows. Such an offset displaces the neutral position of the transition region between the successive in-and-out ribs in adjacent rows from each other by one-half the length of the individual embossed ribs. These neutral positions are designated by the dashed lines 15E–18E in FIG. 2. Since the formation of the embossed rib patterns on the strip involves a drawing of the metal with consequent thinning of the metal in the transition region between successive ribs in each row, an actual weakening of the slat would be produced if all of the neutral locations 15E–18E were aligned laterally across the slat. With a longitudinal displacement of such thinned regions of slat material, adjacent embossment ribs actually provide a strengthening of the slat.

Although the depiction of the embossment rib pattern shown in FIGS. 1 and 2 uses solid lines which tend to indicate a sharp corner in the rib pattern, it should be understood that the actual pattern involves a smooth contour at each location where the direction of the metal substantially changes. This smooth contour is achieved utilizing embossment die sections with rounded corners and surfaces which are highly polished and coated with a thin mirror-like metal such as chrome. The embossment rib pattern is formed on a painted strip without marring the paint surface. The draw of the metal of the strip and of the paint surface thereon is performed in a gradual manner utilizing die elements with tapered surfaces and rounded corners so that breaking or cutting of the metal and/or paint will not occur.

In accordance with this invention, a relatively deep embossment pattern may be formed in the strip in the form of the successive in-and-out pattern of adjacent ribs with the individual ribs having a depth of about 0.015 inch in a strip having a thickness in the range of 0.008–0.010 inch. Such a deep embossment pattern on the slat provides an overall decorative weave appearance to the slat which adds dramatic visual appeal to an overall venetian blind or vertical blind system employing such a patterned slat. This invention is of course not limited to any particular depth of the embossed ribs or any particular width and periodicity of the embossment pattern.

Figure 6:
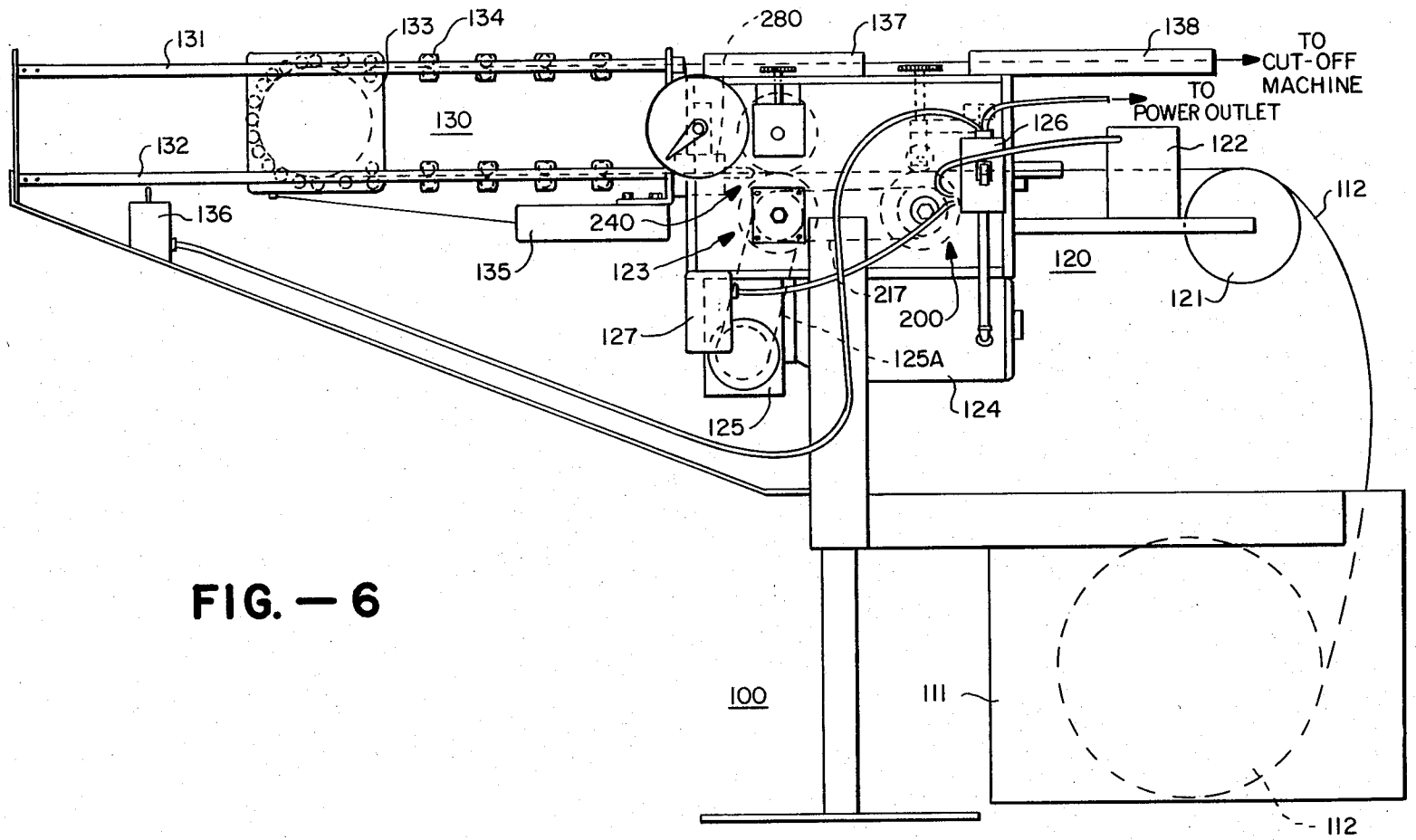
FIG. 6 is an elevational view of a first machine stage incorporating apparatus in accordance with this invention for forming a decorative embossment pattern and crown configuration on a thin metal strip.
Figure 7:
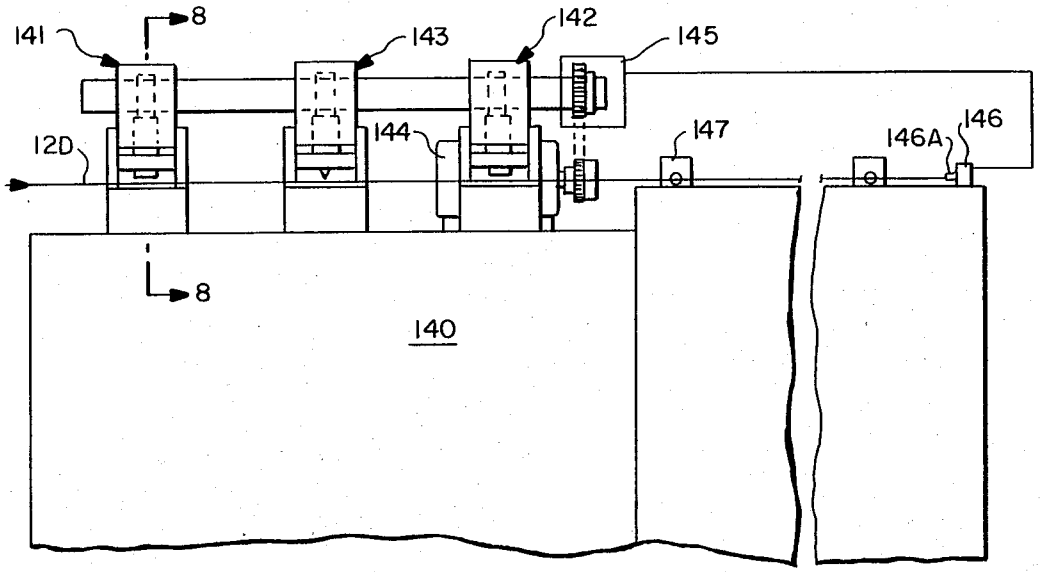
FIG. 7 is an elevational view of a cut-off machine incorporating improved rib-forming die elements in slot forming die stations.

Referring now to FIGS. 6 and 7, a two-stage machine for forming venetian blind slats in accordance with this invention will be described. FIG. 6 shows a first machine stage including strip-forming apparatus 120 mounted on a stand arrangement 100 which includes a narrow box 111 holding a roll 112 of thin metal strip. The thin metal strip from the box 111 is fed over a guide wheel 121 through a detector arrangement 122 into the front entry end of strip forming apparatus 120 contained within a rectangular steel frame 123. The detector arrangement 122 contains a first detector for detecting the absence of a metal strip. Upon sensing the absence of the metal strip the motor 124 driving the strip-forming apparatus 120 is turned off. This enables a new metal strip to be joined to the back end of the depleted metal strip from the last roll so that continuous feeding of the strip through the strip-forming apparatus 120 can be performed.

The detector 122 also preferably includes a strip thickness detector so that two strips of metal on the same roll which have been spliced together in overlapping fashion will be detected and the strip-forming apparatus shut off. The rotary dies in strip-forming apparatus 120 might be damaged by a double thickness strip so it is preferable to turn the apparatus off so that the proper splicing of the metal strips together can be performed. This splicing can be done by utilizing overlapping six inch sections of tape to hold the strips together end to end.

The strip-forming apparatus 120 is driven by an electric motor 124 and gear box 125. A drive chain 125A powers the second rotary die station 240 and another chain 217 provides an initial drive to a first rotary die station 200 for initial threading of the metal strip 112. A one-way lock bearing together with a smaller number of teeth are utilized on the chain sprocket in the first rotary die station so that the die wheels in the second rotary die station will be rotating faster than the first rotary die station. The one-way lock bearing on the sprocket at the first rotary die station permits slippage in one direction and thus allows the second rotary die station to pull the thin metal strip through the first rotary die station. The thin metal strip is pushed through a third die station 280 which is a compensating die station. After that the strip passes out of the multistation die apparatus into a strip interface arrangement 130.

The strip interface arrangement 130 includes upper and lower strip guide mounting tracks 131 and 132. The lower strip guide track 132 is positioned in alignment with the strip exit from the strip-forming apparatus 120. A plurality of individual strip guide elements 134 are mounted in each of the upper and lower guide tracks 131 and 132. Each of these guide elements has a pair of guide rollers crowned and patterned strip. A strip turnaround guide 133 is mounted in the upper and lower guide tracks 131 and 132 for a guided turnaround of the strip between the lower and upper tracks. The strip preferably leaves the strip-forming apparatus 120 with its concave side up and gets turned in the strip turnaround guide 133 to have its concave side down. The strip is then guided through a pair of guides 137 and 138 mounted on top of the strip-forming apparatus 120 into the cutoff machine arrangement depicted in FIG. 7.

A tensioning apparatus 135 is attached to the strip turnaround guide 133 to urge the strip turnaround guide toward the exit end of the strip-forming apparatus 120. The tensioning arrangement 135 is preferably a variable tensioning arrangement so that the tension can be set precisely to counteract the outward thrust on the turnaround guide means 133 caused by the crowned strip passing therethrough. A limit switch arrangement 136 is provided to turn off the current to the motor 124 driving the strip-forming apparatus 120 if the strip turnaround guide 133 reaches the actuator on the switch. The strip-forming apparatus 120 is shut off if excess length of the crowned strip is accumulating on the interface stage 130 due to some malfunction of the cutoff machine. Preferably the linear speed of the strip through the strip-forming apparatus 120 will be set in accordance with the speed of operation of the cutoff machine so that a relatively continuous feed of the crowned strip into the cutoff machine will result. The tension in the tensioning means 135 can then be set so that the strip turnaround guide 133 will be positioned in a neutral position in front of the limit switch arrangement 136 and continuous strip feed will occur unless the strip is jammed in the cutoff machine.

Another safety feature which is provided on the strip-forming apparatus 120 is a strip braking arrangement. The box 127 contains a solenoid operated spring brake arrangement (details not shown) which includes a rod reaching vertically through the frame 123 of the strip-forming apparatus 120 to a strip brake pad which is positioned over the strip at the top of the machine. The solenoid keeps the strip brake pad in a position above the strip unless the power switch in the box 126 cuts off all power to the strip-forming apparatus 120.

At this time the solenoid is deactuated and a spring urges the strip brake pad into contact with the strip, thereby preventing the tensioning means 135 from pulling the strip turnaround guide 133 toward the front of the interface stage 130. This prevents any buckling of the strip in the cutoff machine if the power to the strip-forming apparatus 120 is cut off. It should be noted that the spring-operated break is not actuated when the limit switch 136 is triggered, but only when the power switch at the box 126 is cut off.

FIG. 7 shows a relatively standard arrangement of a cutoff machine for venetian blind slats. Cutoff machine 140 has slot-producing die stations 141 and 142 which are modified in accordance with this invention to provide the embossed ribs on the marginal edge portions of the slat adjacent the cord receiving slots formed therein. The die station 143 is a cutoff die which simply cuts the blind slat to length. The crowned and patterned strip from the crowning and embossing machine stage shown in FIG. 6 passes through the die stations 141, 143 and 142 until the end thereof strikes a spring-loaded switch actuator 146A on switch 146. This switch 146 sends a signal to an electrically actuated clutch arrangement 145 causing operation of the die stations 141–143. Simultaneously the slots in the strip are formed and the strip is cut to length. After the slat has been cut to length, a slat removal mechanism 147 is utilized to remove the cut slat from the cutoff table, allowing the next length of strip to be fed to the switch 146. The punch and cutoff dies operate very quickly and introduce only minor delay into the travel of the crowned and embossed strip from the prior machine stage.

Figure 8:
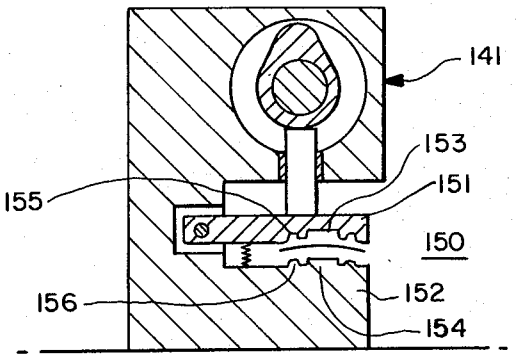
FIG. 8 is a section view taken along the lines 8—8 in FIG. 7 and showing an improved die arrangement in accordance with this invention.

FIG. 8 shows the modification to the die stations 141 and 142. The die assembly 150 in the die station 141 for example includes a scissors-type die having an upper die section 151 and a lower die section 152. Male and female die elements 153 and 154 form the slot in the slat passing therebetween. At the same time male and female embossing die elements 155 and 156 form the embossed ribs in the slat adjacent the slots. It will thus be appreciated that the formation of the slat-strengthening ribs at the slot locations is performed without any additional production cost or additional strip processing stages in the production process. It should also be appreciated that this feature of forming embossment ribs adjacent the slot can be utilized on an unpatterned blind slat for the same slat strengthening purposes.

It should also be appreciated that the first machine stage of this invention shown in FIG. 6 may be utilized to produce crowned and patterned slats for use in vertical blind systems. Such a use of the crowning and embossing machine shown in FIG. 6 may also involve a second machine stage for cutting the strips to length. It may also involve other punch die operations on the slat for creating mounting holes and the like. It should thus be understood that this invention is not limited to any particular form or usage of crowned and embossed slat.

Figure 9:
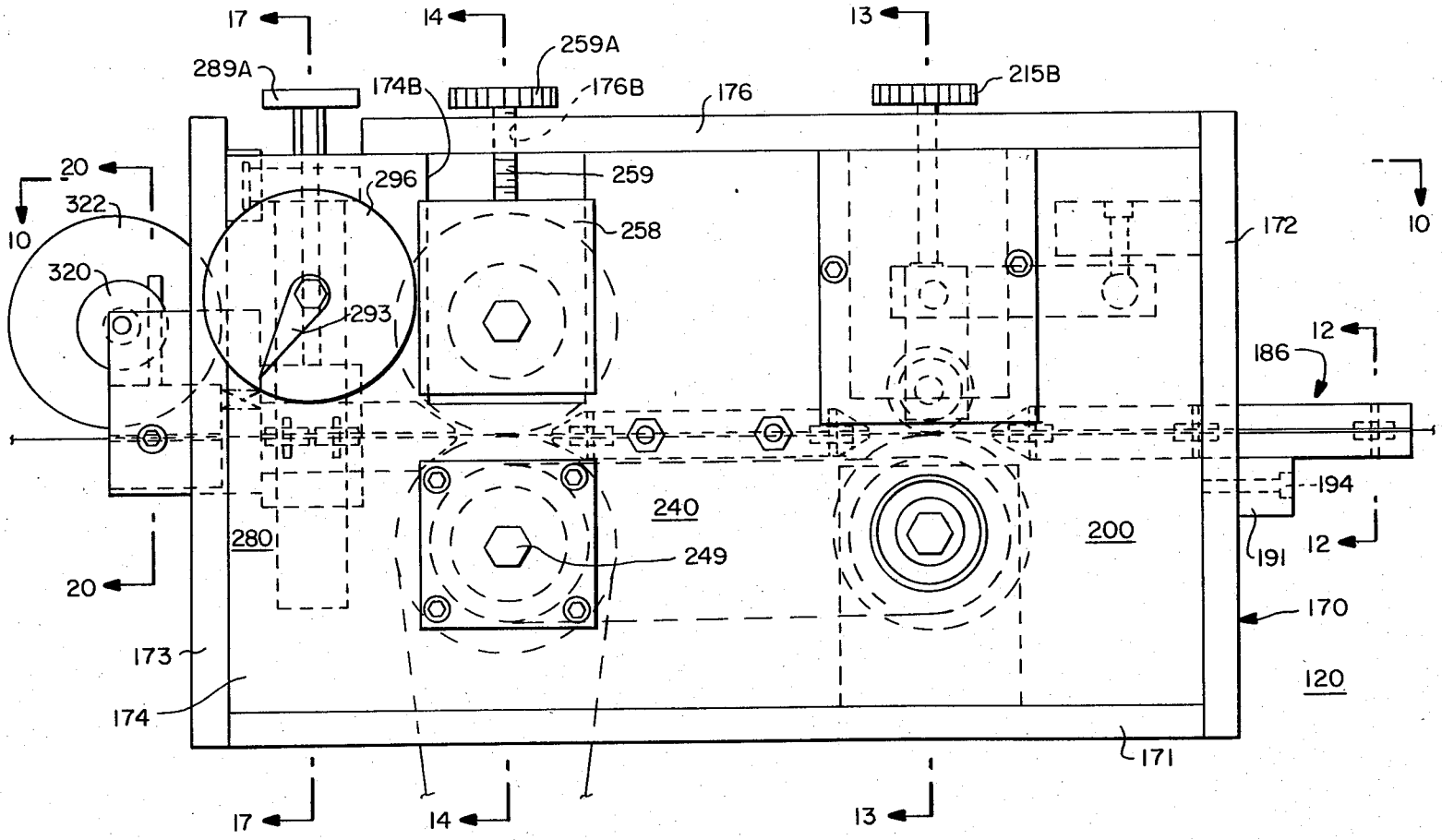
FIG. 9 is a side elevation view of apparatus in accordance with this invention for forming a crowned and patterned metal strip.
Figure 10:
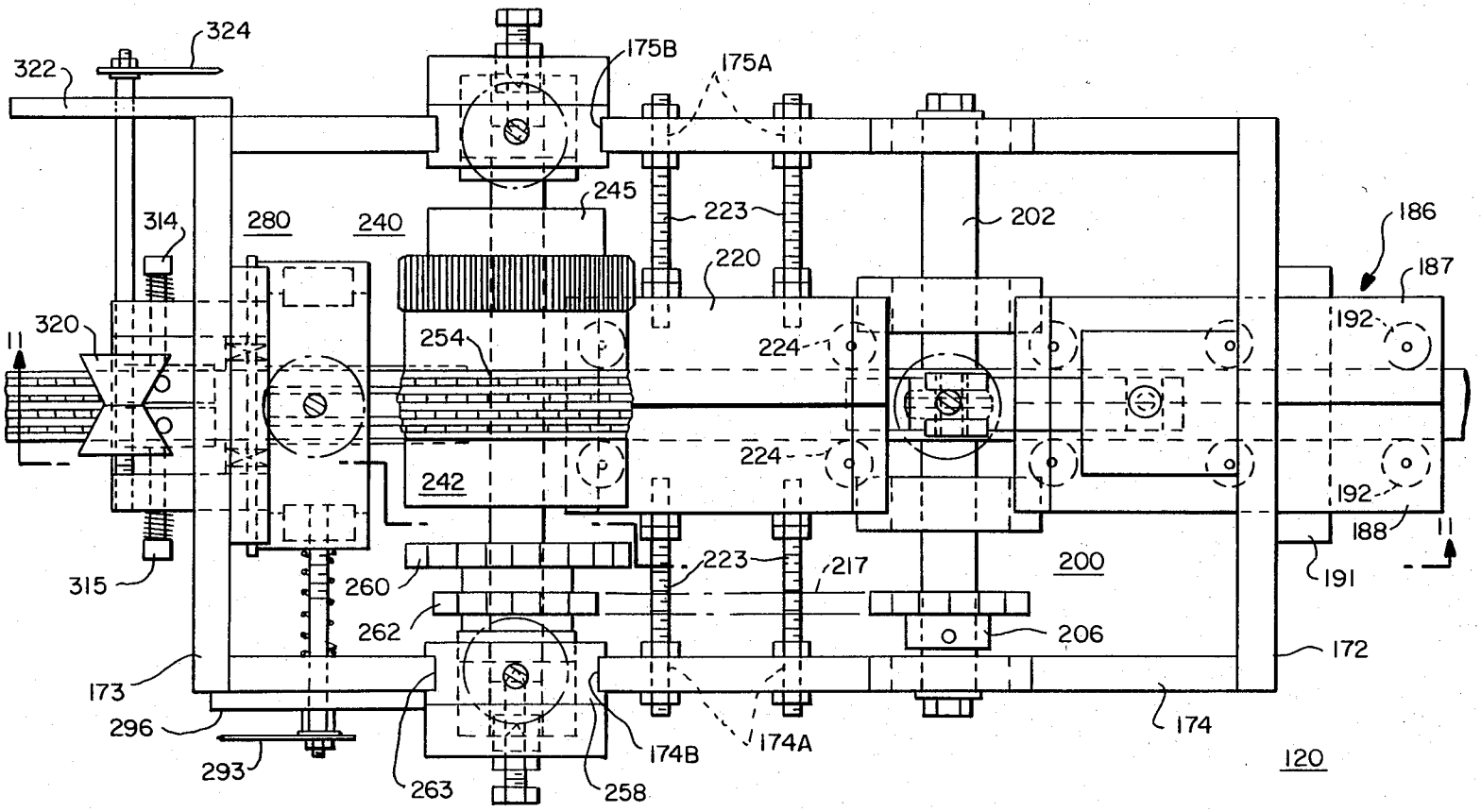
FIG. 10 is a top view of the apparatus of FIG. 9.
Figure 11:
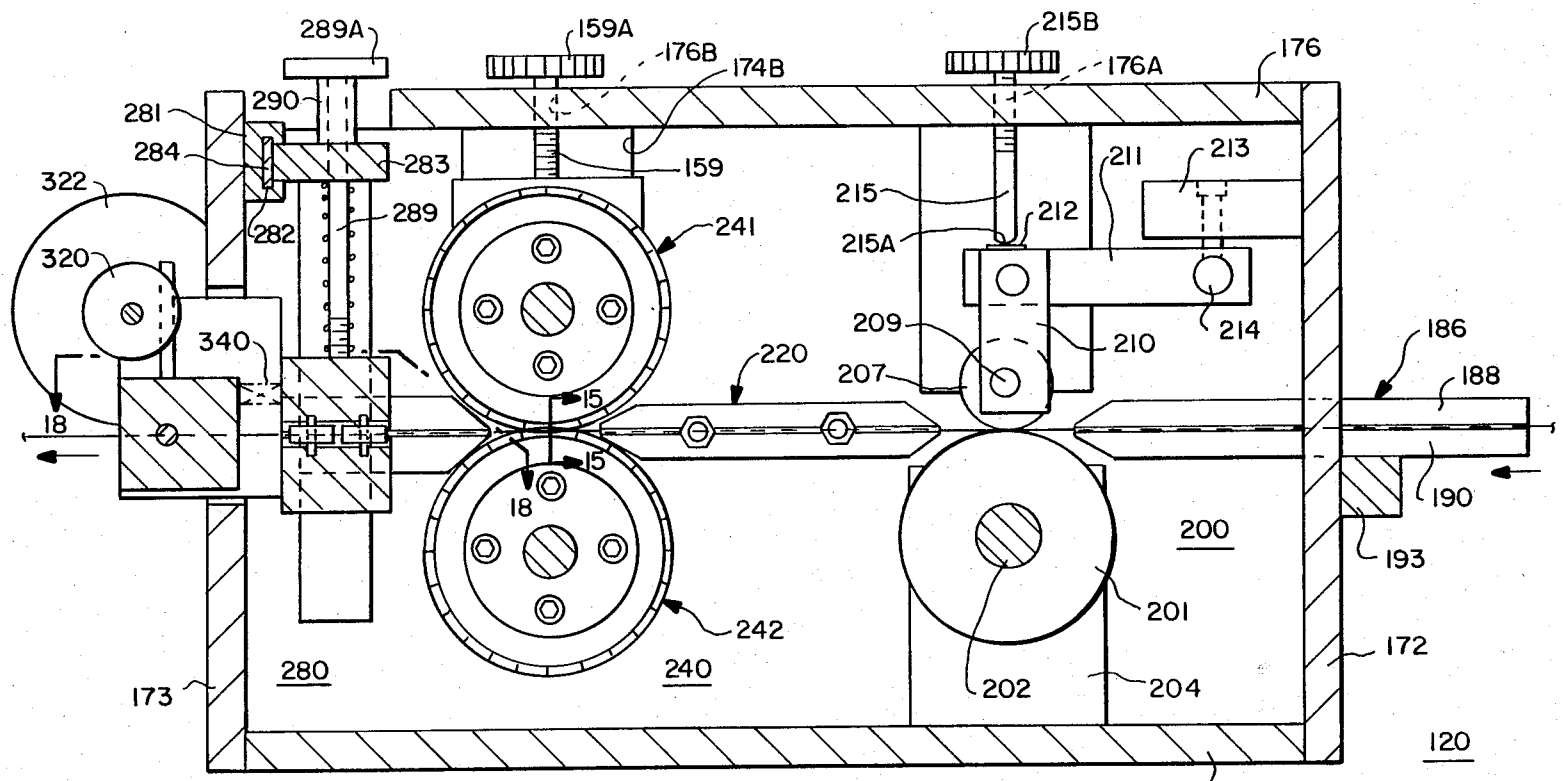
FIG. 11 is a partly sectioned side elevation view taken along the line 11—11 in FIG. 10.

Referring now to FIGS. 9–21, the details of a preferred embodiment of strip-forming apparatus 120 will be discussed. As shown in FIGS. 9–11 the preferred apparatus of this invention involves three die stations 200, 240 and 280 mounted within a rectangular frame 170. The flat metal strip 112 enters the strip-forming apparatus 120 through an inlet strip guide 186. The inlet strip guide guides the straight metal strip into a first rotary die station 200 which performs a controlled stretching of a thin central region of the metal strip. The metal strip then is guided through a second strip guide arrangement 220 into a second rotary die station 240 which simultaneously forms a plurality of separated longitudinal rows of embossed ribs on the strip in a continuous in-and-out pattern of successive ribs and forms a crown configuration in the strip. The crowned and embossed strip then enters a third die station 280 which is basically a compensating die station. The compensating die station 280 removes any detected side curve, bow and/or twist in the strip.

Figure 12:
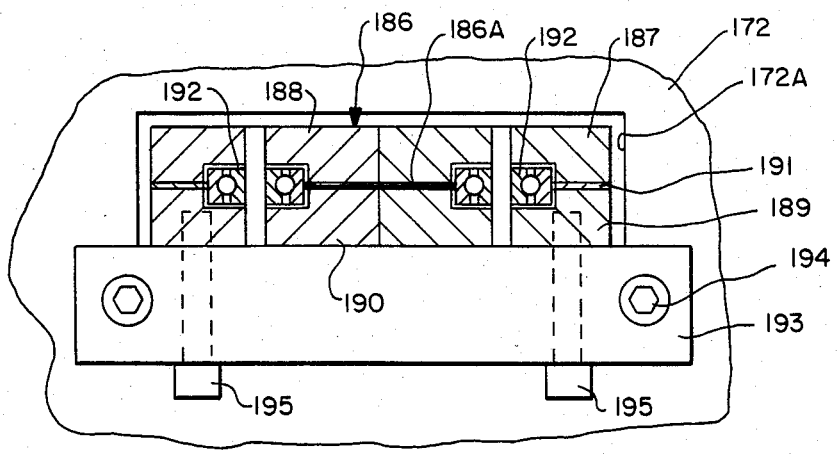
FIG. 12 is a partly sectioned view taken along the line 12—12 in FIG. 9.
Figure 13:
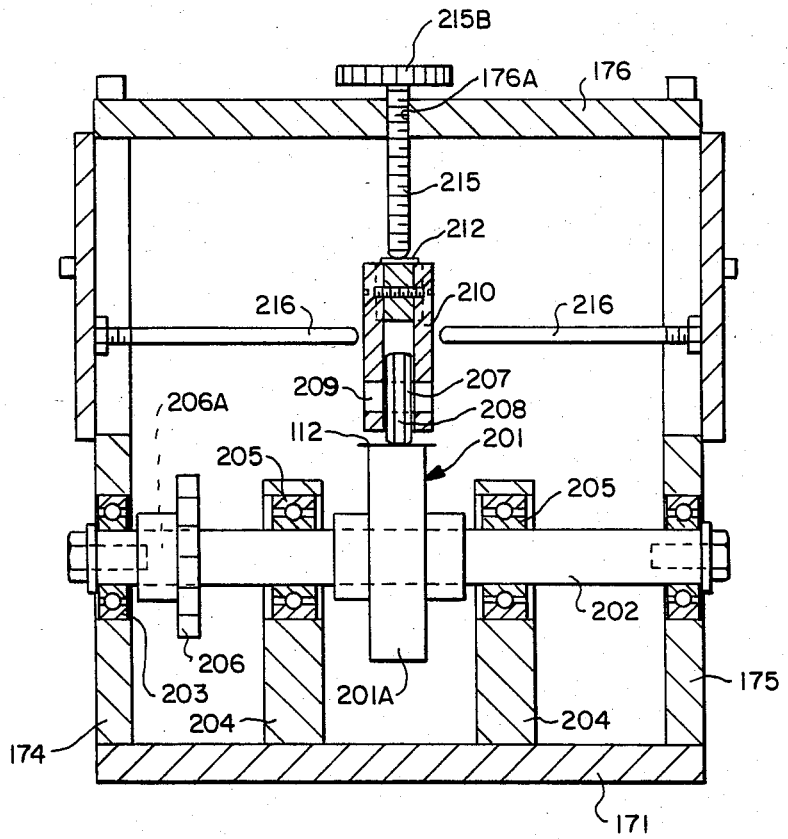
FIG. 13 is a section view of the apparatus of FIG. 9 taken along the lines 13—13.
Figure 14:
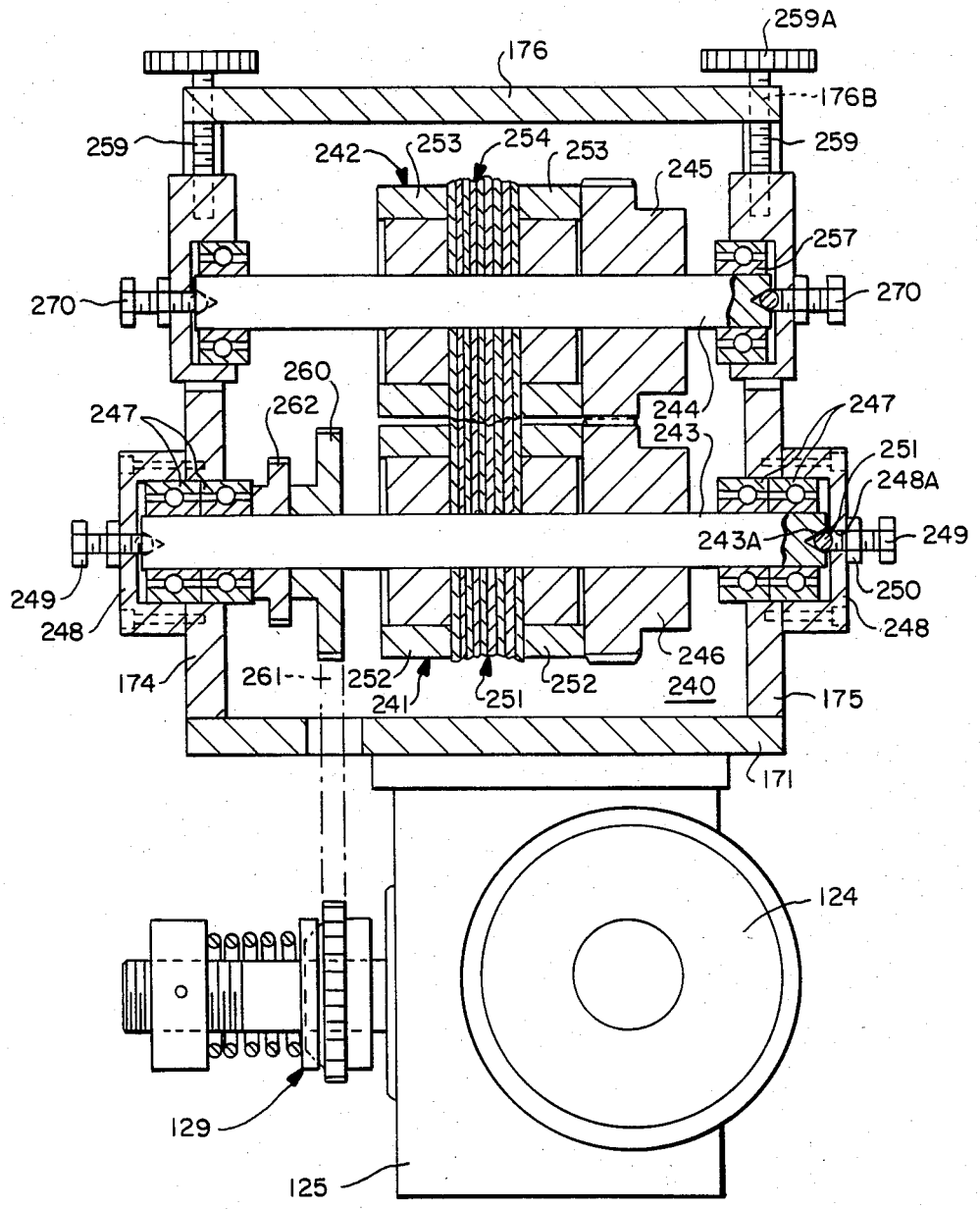
FIG. 14 is a section view of the apparatus of FIG. 9 taken along the line 14—14.

The structure of the strip guides 186 and 220 can best be seen in FIG. 10, 11 and 12. FIG. 12 in particular shows a cross-section through the entry strip guide 186, but the structure of the intermediate strip guide 220 is essentially the same. The entry strip guide 186 is mounted to a bracket 193 utilizing mounting screws 195. The bracket 193 is in turn fastened to the front wall 172 of the frame 170 utilizing an appropriate fastening arrangement such as screws 194. Strip guide 186 extends through a rectangular aperture 172A in the front wall 172.

Strip guide 186 may conveniently be formed from four separate rectangular metal blocks 187–189 assembled together with spacers 191 which define the height of the strip receiving slit 186A. Preferably bearings 192 are mounted within the strip guide at the various positions shown, with the circumferential surfaces of the bearings furnishing the side guide arrangement for the strip. In this manner the flat metal strip is accurately guided into the first rotary die station 200 but with only rolling friction contact between the edges of the strip and the bearing guides 192. As shown in FIGS. 9 and 10 three sets of bearing guides 192 are preferably utilized in the embodiment shown. However, it may be possible to utilize only a front and rear pair of bearing guides or, if desired, a larger number of bearing guides could be employed.

The purpose of the entry strip guide arrangement 186 is to accurately guide the continuous metal strip 112 into the first rotary die station 200. As shown best in FIGS. 10, 11 and 13, a preferred embodiment of the first rotary die station 200 includes a first die wheel 201 and a second die wheel 207 positioned on opposite sides of the strip 112 passing therebetween. The lower die wheel 201 has a carefully machined and polished circumferential surface 201A to avoid any marring of a painted strip in contact therewith. The first die wheel 201 is mounted on a shaft 202 which is journaled for rotation in a bearing arrangement consisting of bearings 203 mounted in the side panels 174 and 175 of frame 170 and bearings 205 mounted in separate support post 204 mounted to the bottom 171 of the frame. A chain sprocket 206 and a chain 217 are utilized to power the shaft 202 during initial threading of a strip into a first rotary die station 200. The sprocket 206 is mounted to the shaft 202 with a one-way lock bearing designated 206A. The sprocket 206 has fewer teeth than the corresponding sprocket 262 on the powered shaft 243 of the second rotary die station so that the shaft 243 will turn at a faster rotation than the shaft 202. Accordingly, as soon as the strip is threaded through the embossment die arrangement of the second rotary die station 240, the shaft 202 and lower die wheel 201 will be turning at a faster rate than the sprocket 206. The one-way lock bearing permits this faster rotation to occur and enables the rotation of the second rotary die stage to control the pulling of the strip 112 through the upper and lower die wheels 201 and 207 of the first rotary die station 200.

The upper die wheel 207 is mounted for rotation in bearings 209 which in turn are mounted to a frame 210. The frame 210 is mounted in a suspended trailer-like fashion with a horizontal tongue element 211 mounted with a ball swivel arrangement 214 to a bracket 213 which is fastened to the front wall 172 of the frame 170. A pair of restraining arms 216 are mounted to the side walls 174 and 175. These restraining arms do not actually touch the sides of the frame 210 but generally limit the swing of the frame 210 on the swivel mount 214 so that the die wheel 207 will remain in position generally above the die wheel 201 without the presence of a strip therebetween. This assists in threading the machine with the strip when required.

A force adjustment screw 215 is threaded through a threaded aperture 176A in a top frame element 176 and its polished and rounded head is 215C in contact with a hard metal plate 212 provided on the top of frame 210. Accordingly, the head 215B on the screw 215 may be turned to put pressure on the frame 210 to force the die wheel 207 into pressurized contact with the strip 12. A narrow circumferential rib 208 is formed on the die wheel 207 and it is this narrow rib which actually contacts strip 112 passing between the upper die wheel 207 and lower die wheel 201.

Screw 215 and the polished plate 212 are both preferably made of a hard steel material which is highly polished and lubricated to form a smooth bearing surface. With the pressure applied by the screw 215 to the frame 210, and the trailer-type mounting of the frame 210, the upper die wheel 207 will track to dead center of the strip 112. The circumferential rib 208 on the upper die wheel 207 functions to perform a controlled stretching of the narrow central region of the strip 112 since the strip 112 is being pulled with substantially tension through the die wheels 201 and 207. The amount of stretching is controlled by the force applied by the screw 215. As will be discussed later, this controlled stretching of a central portion of the strip 112 is an important prestretching operation which enables the action of the crown forming and embossment die wheels at the second rotary die station 240 to form the crown configuration and embossment pattern on the strip without creating any substantial distortions in the strip.

It is important that the circumferential surface of the rib portion 208 on the die wheel 207 and the outer circumferential surface 201A of the lower die wheel 201 be very accurately machined so that a uniform controlled pressure is applied to the strip 112 for prestretching of the central portion of the strip by a consistent uniform amount. The mounting bracket 213 should be precisely located in alignment with the center line of the inlet strip guide 186 so that the upper die wheel 207 will track to dead center on the strip.

It has been proven in practice that accurate controlled prestretching of a central region of a strip at this first rotary die station 200 enables the embossing and crown forming rolls at the second die station 242 to perform their functions without gross strip distortions. There are, however, other prestretching arrangements which could also be employed. For example, depending on the depth of embossment to be formed in the strip at the second die station 240, it may be satisfactory to utilize at the first rotary die station 200 a pair of highly polished rounded-tooth gear wheels which prestretch the strip 112 at each of the four regions at which the longitudinal pattern of in-and-out embossments is formed in the subsequent embossment process. It is also possible to utilize an upper die wheel 207 which has, in addition to the central circumferential rib 208, a pair of separate circumferential ribs which contact the strip generally in the unembossed regions 20 and 22 shown in FIGS. 1 and 2 for some prestretching of the strip in those regions as well. Preferably the degree of prestretching is heavier in the central region which can be achieved by making the diameter of the side ribs slightly smaller. It has been found that a sufficient prestretching of the slat at one or more selected regions in a first rotary die station is vital to enabling a deep embossment pattern to be formed on the strip without producing deformities which can be corrected out of the strip. Utilizing the preferred approach shown in FIG. 13, it is believed that the central region of the slat is reduced in thickness by about 0.001 inch. The setup of the machine to initially calibrate the amount of pressure applied by the rib 208 on the upper die wheel 207 will be discussed below in connection with the overall setup calibration of the strip-forming apparatus 120.

After the strip 112 passes through the first rotary die station 200 it is guided into the second rotary die station 240 by an intermediate strip guide 220 which has the same basic structure as the entry strip guide 186. However, the intermediate strip guide 220 is somewhat shorter and has only two sets of bearing guides 224 mounted therein. Threaded shafts 223 are utilized to position the intermediate strip guide 220 laterally within the frame 170 for alignment of the center of the intermediate strip guide 220 with the true dead center of the entering strip guide 186. In this manner the strip is guided in straight alignment through the first rotary die station 200 and into the embossing and crown forming dies of the second rotary die station 240.

A preferred version of the second rotary die station 240 includes a lower rotary die assembly 241 mounted on a shaft 243 and an upper rotary die assembly 242 mounted on a shaft 244. Intermeshed upper and lower gears 245 and 246 are mounted on the shafts 243 and 244 to provide synchronous rotation of the die assemblies 241 and 242. The lower shaft 243 is journaled for rotation in bearings 247 on each end of the shaft which are mounted in the side panels 174 and 175 of the frame 170. End brackets 248 are mounted over the bearing assemblies 247. A threaded aperture 248A is provided in brackets 248 to receive an adjustment screw 249. A V-shaped groove 243A is formed in each end of the shaft 243 and receives a small steel bearing 251. The end 249A of the adjustment screw 249 has a rounded recess machined therein to form a bearing surface for the spherical bearing 251. By means of the position adjusting screws 249, the lateral position of the shaft 243 within the frame 170 can be adjusted. Lock nuts 250 are utilized to lock the shaft in a calibrated position. The of this shaft mounting arrangement in initial setup and calibration will be discussed in detail below.

The upper shaft 244 is journaled for rotation in bearings 257 which are mounted in slide brackets 258. The slide brackets 258 have recessed side slots 263 which enable the bracket 258 to slide vertically within rectangular openings 174B and 175B in the frame side walls 174 and 175. Adjustment screws 259 extend through threaded apertures 176B in top wall elements 176 and are fastened in a top aperture of the sliding brackets 258. In this manner the vertical position of each end of the shaft 244 may be separately controlled using the adjustment screws 259. The horizontal position of the upper shaft 244 is controlled using an adjustment screw arrangement 270 identical to the one for the lower shaft. Accordingly, the upper shaft 244 may be adjusted both horizontally and vertically with respect to the lower shaft 243. The purpose of this horizontal and vertical adjustment feature will be described in detail below.

A chain sprocket 260 is mounted on the lower shaft 243 and a drive chain 261 mounted on the sprocket 260 extends to a clutch and sprocket arrangement 129 on the gear head 125 so that the lower shaft 243 is driven by the motor gear and chain drive arrangement.

The upper and lower die assemblies 241, 242 each comprise a central arrangement of embossment and roll forming die elements 251, 254 and a side arrangement of mounting collars 252, 253. The mounting collars and individual die elements are fastened to and maintained in a registered position on the upper and lower shafts 243 and 244. Any appropriate means such as cooperating keys, keyways and splines or screws may be utilized to position and fix the various elements of the die assembly on the respective shafts and lock them together for rotation.

Figure 15:
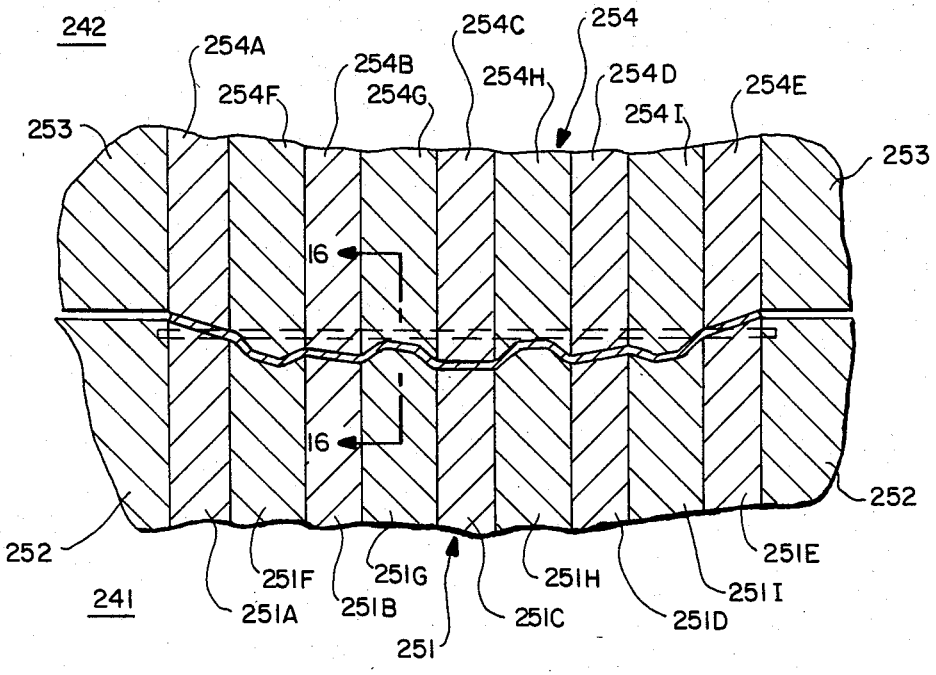
FIG. 15 is a fragmented section view taken along the line 15—15 in FIG. 11.
Figure 16:
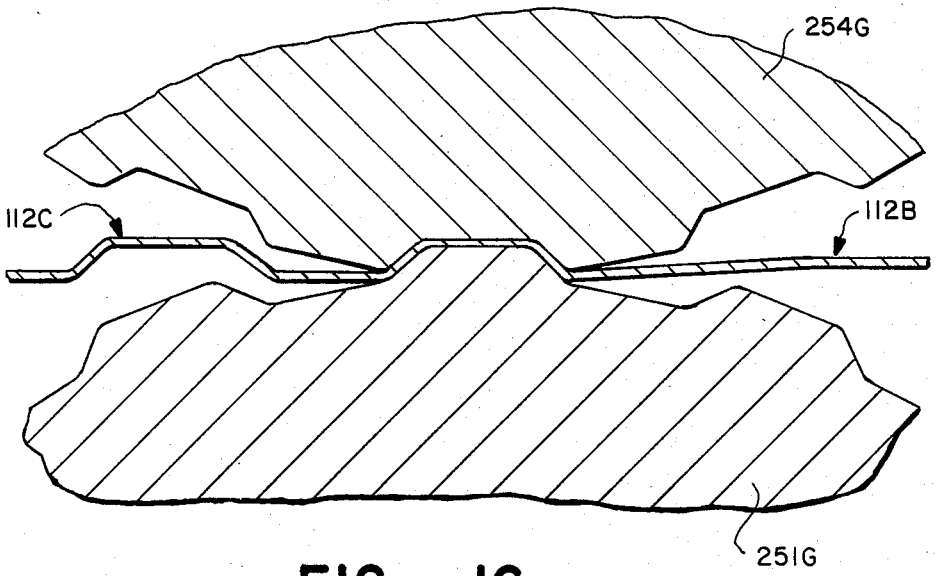
FIG. 16 is an enlarged fragmented section view taken along the lines 16—16 in FIG. 15.
Figure 17:
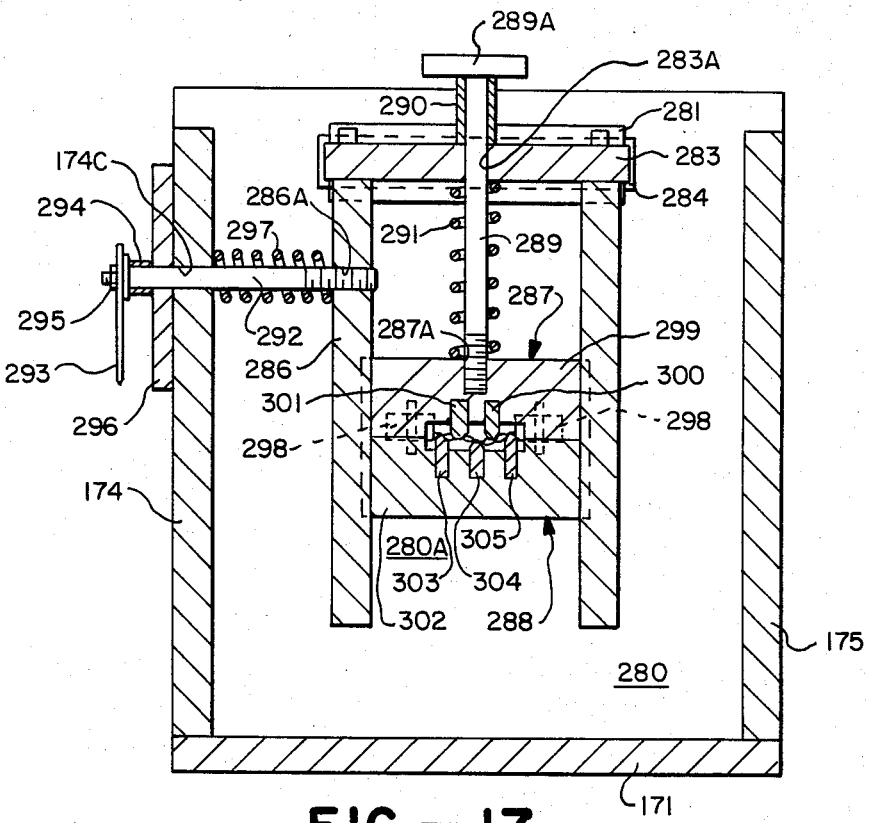
FIG. 17 is a section view of the apparatus of FIG. 9 taken along the line 17—17.
Figure 18:
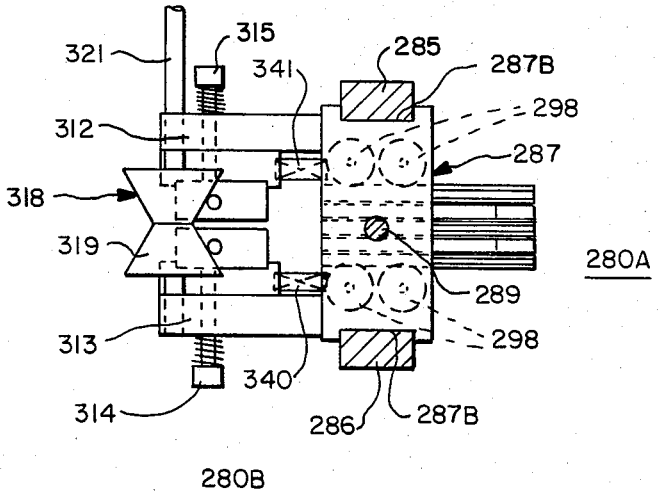
FIG. 18 is a top view of a portion of the apparatus of FIG. 9 taken along the line 18—18 in FIG. 11.
Figure 19:
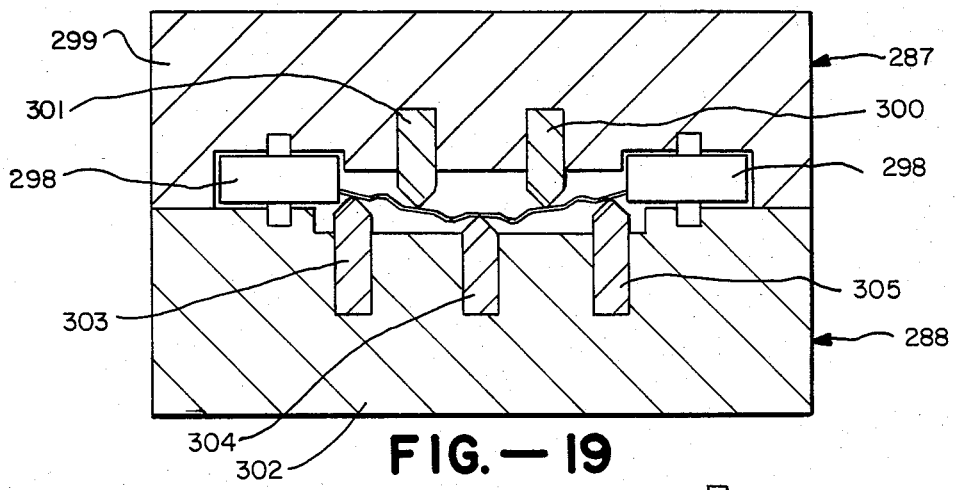
FIG. 19 is an enlarged view of a portion of the apparatus shown in FIG. 17.
Figure 20:
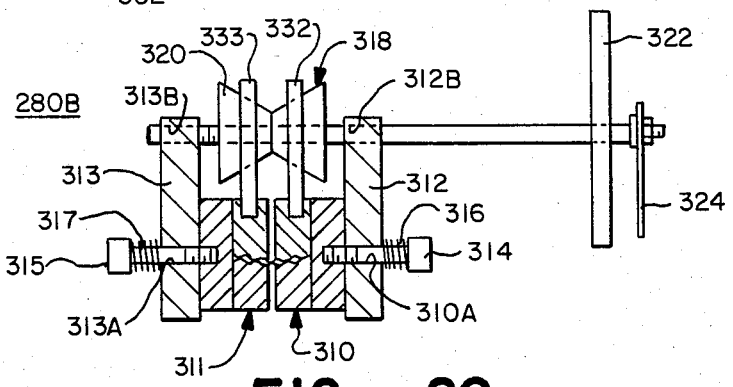
FIG. 20 is a section view of the apparatus of FIG. 9 taken along the line 20—20.
Figure 21:
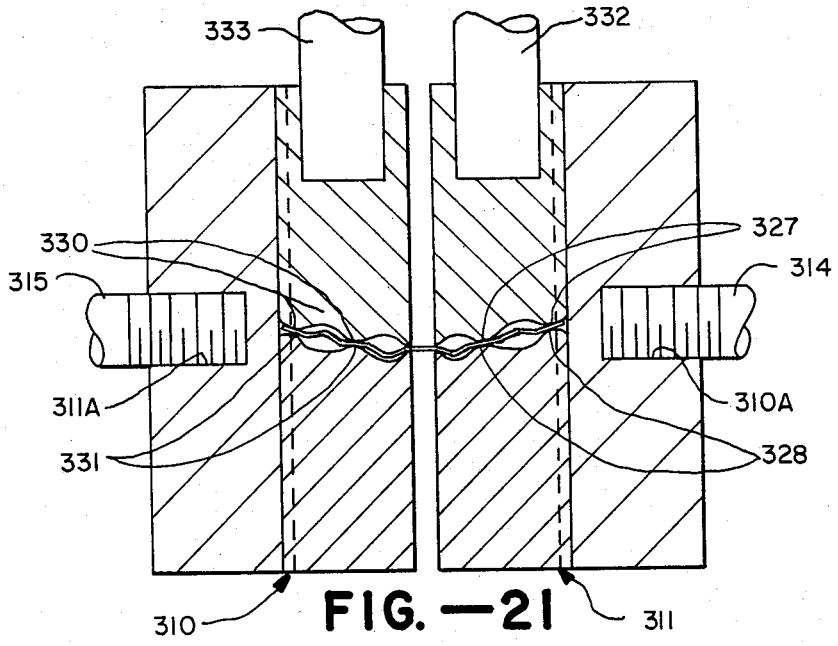
FIG. 21 is an enlarged view of a portion of the apparatus of FIG. 20.

FIGS. 15 and 16 depict the structural configuration of the individual die wheel elements which comprise the embossment and roll forming die assemblies 251 and 254. The die assembly 251 comprises individual roll forming die wheels 251A–252E and individual embossment die sections 251F–251I. Each of the embossment die sections is mounted between successive roll forming die sections. A corresponding arrangement of roll forming die sections 254A–254E and embossment die sections 254F–254I is provided in the upper die assembly 254.

As shown in FIGS. 15 and 16 each of the embossment die sections, e.g. embossment die section 251G and embossment die section 254G as shown in FIG. 16, has a circumferential arrangement of individual male and female die elements. Each of the male die elements has generally the shape of a truncated pyramid with rounded corners and a top surface which is angled to match the diameter of the crown to be formed in the strip. Each of the female die elements has a configuration matching the corresponding male die element, again with rounded corners and a bottom surface which corresponds to the diameter of the crown configuration to be formed in the strip. Each of the roll forming die section has an outer circumferential surface which is shaped, depending on the position of the die section, to match the crown configuration to be formed in the strip.

FIG. 15 shows that the strip 112 is fed into the intermeshed assemblage of die elements at essentially the midpoint of the crown configuration to be formed in the strip. Each of the die section assemblies 251 and 254 are very carefully formed to provide a very high quality embossment of the metal strip passing through the embossment rolls. It will be appreciated that the forming of such deep embossments in a painted metal strip simultaneously with the forming of a crown configuration without marring the painted surface of the strip or cutting the strip requires very high precision embossment die sections. The embossment die sections are first precisely formed and then highly polished. Thereafter they are smoothly finished with a thin coating of a smooth metal such as chrome which is then highly polished. In this manner a deep embossment patterns can be formed in a relatively hard metal slat with a painted surface without any marring of the paint, provided that of the respective embossment die assemblied are accurately aligned with each other and with the strip. This alignment process is performed as part of the overall alignment of the strip-forming apparatus 120 and will be described in detail below.

After the crowned and embossed metal strip leaves the second rotary die station 240, it enters the third die station 280. A preferred version of the third die station 280 is shown in details in FIGS. 9 and 11 together with FIGS. 17–21. Compensating die station 280 includes a first compensation die 280A which functions to remove a detected side curve and/or bow from the crowned and embossed strip and a second compensation die 280B to remove any detected twists. Bow and side curve compensation die 280A and twist compensation die 280B are mounted on a common frame and bracket arrangement with careful alignment of the two dies such that a strip which requires no compensation will pass straight through both dies and not be twisting or otherwise distorted. Both of the compensation dies are carried on a mounting arrangement which permits horizontal and vertical adjustment of the dies with respect to the frame 170.

A slide bracket arrangement is provided for this purpose and includes a fixed bracket 281 with a slot 282 formed therein mounted to the back wall 173 of the frame. A slide bracket 283 with a slide 284 mounted thereto is received in a slidable fashion in the slot 282 so that the slide bracket 283 is free to move from side to side between the side panels 174 and 175. A pair of vertical brackets 285 and 286 extend vertically downward from the horizontal bracket 283 forming a vertical slide arrangement for the upper and lower die frames 287 and 288. The slots 287B in the upper die frame 287 and corresponding slots in the lower die frame 288 embrace the side brackets 285 and 286. The upper and lower die frames 287 and 288 are fixed together for joint vertical motion on the slide brackets 285 and 286.

An adjustment screw 289 has a threaded bottom end which is received in a threaded aperture 287A in the upper die frame 287. A compression spring 291 extends between the bottom surface of the slide bracket 283 and the top surface of the upper die frame 287. A bushing 290 maintains the head 289A of adjustment screw 289 in a fixed position above the horizontal bracket 283. The adjustment screw 289 extends through an aperture 283A in the horizontal bracket 283. Accordingly, as the adjustment screw 289 is turned into the upper die frame 287, the die assemblies 280A and 280B move upward. Correspondingly, as the adjustment screw 289 is turned out of the threaded aperture 287A the die assemblies move downward.

Horizontal adjustment screw 292 is provided with a threaded front end which is received in a threaded aperture 286A in the side bracket 286. A compression spring 297 extends between the side panel 174 and the side bracket 286. The adjustment screw 292 has a pointer 293 mounted to the head thereof for example, by way of a mounting bolt 295. A nylon washer 294 may be utilized to displace the pointer 293 away from a fixed dial 296 mounted to the side panel 174. Accordingly, as the position of the pointer 293 is adjusted to turn the adjustment screw 292 in or out of the vertical bracket 286, the bracket assembly 280D will move horizontally to one side or the other.

The first compensating die assembly 280A comprises the upper and lower die frames 287 and 288 which define a central strip receiving channel. A pair of strip engaging fingers 300, 301 are mounted in the upper die frame 287 and three strip engaging fingers 303–305 are mounted in the lower die frame 288. The strip engaging fingers 301–305 extend forward from the upper and lower die frames to a position closely adjacent the exit point of the strip from the second rotary die station. The forward ends of the strip engaging die fingers are tapered to provide adjustment clearance to the embossing and roll forming die sections 251 and 254. Preferably a slight tapering of the initial inner surfaces of the die fingers is also provided for ease of initial threading the metal strip through the die. Two sets of bearings 298 are mounted in cavities within the upper and lower die frames 287 and 288 to provide the side guide surfaces for the edges of the crowned and embossed strip. The strip contacting die fingers 301–305 have tapered and highly polished strip contacting surfaces and are positioned to contact the strip at the unembossed regions 19–23 shown in FIGS. 1 and 2.

The twist compensation die 280B includes right and left half die assemblies 310 and 311 mounted for rotation on side brackets 312 and 313 which are in turned fastened with mounting screws to the upper and lower 287 and 288 of the first compensation die assembly 280A. Mounting screws 314 and 315, together with compression springs 316 and 317 provide the rotational mounting of right and left half die elements 310 and 311 on brackets 312 and 313. These mounting screws are positioned accurately at the midpoint of the crowned and embossed strip passing through the right and left half die sections 310 and 311 so that no bow will be introduced into the strip in passing through the twist compensation die arrangement 280B. The right half die assembly 310 includes upper and lower projecting fingers 327 and 328 to contact the unembossed portions of the crowned and embossed strip passing therethrough. A similar arrangement of upper and lower 330 and 331 are provided in the left half die assembly 311.

A rotation adjustment arrangement 318 is provided for the right and left half die sections 310 and 311. Individual posts 332 and 333 project upward from the right and left half die sections 310 and 311 and are urged into contact with facing truncated cone positioning elements 319 and 320 which are mounted on an adjustment screw 321. The front end of adjustment screw 321 is threaded and received in a threaded aperture 313B in the side frame 313 so that the horizontal position of the facing truncated cones 319 and 320 may be adjusted by rotating the pointer 324 attached at the front end of the screw 321. A pair of compression springs 340, 341 urge the posts 332 and 333 into contact with the truncated cones 319, 320. Accordingly, as the horizontal position of the truncated cones shifts, the right and left die elements 310 and 311 will rotate in opposite directions and thereby impart a twist to a crowned and embossed strip passing through the die sections.

To operate effectively to produce a deep embossment pattern and crown configuration on a continuous thin metal strip without marring the painted strip surface and without producing uncorrectable distortions in the metal, it is necessary to perform a calibration setup of the die stations when the apparatus is first assembled. First of all, it it important to align the center of the ball swivel arrangement 214 in the first rotary die station 200 with the center line of the strip entry guide 186. With this alignment the upper die wheel 207 will track to true dead center on the strip. This alignment can be achieved either by very accurate positioning of the various mounting screw locations or by providing slots in the various bracket elements to enable a horizontal positional adjustment of the strip entry guide 186 with respect to the center of the ball joint 214.

The position of intermediate strip guide 220 is then adjusted so that its center line is aligned with the center of the entry strip guide 186. The next step is to adjust the position of the lower shaft 243 at die station 240, using the adjustment screws 249, to center the embossment pattern on the strip of metal. Then the horizontal and vertical positions of the upper shaft 244 are adjusted for proper horizontal alignment of the die assembly 254 with the die assembly 251 and for appropriate intermeshing of these die assemblies. The horizontal positioning is done with adjustment screws 270 and the vertical positioning is done with adjustment screws 259.

The overall calibration is performed on a trial and error basis by running known straight strips of metal through the machine and making slight adjustments of the seven permanent adjustment screws on the machine based on inspection of the quality of the slat produced. This is all done before adding the compensating die station 280 to the apparatus. Once these permanent adjustments have been accomplished, they are retained throughout the operation of the machine. Recalibration is only necessary if the machine is repaired and parts such as bearings are replaced due to wear or other malfunction.

It will be appreciated that, even after the machine has been calibrated, some slat distortion will tend to occur due to the differences in inherent stresses, etc. in rolls of metal strip passing through the machine. The compensating die station 280 is provided to remove any such distortion detected in a particular roll of metal strip. The head 289A on the adjustment screw 289 controls the vertical position of the compensating die arrangement 280A to correct out any upward or downward bow in the strip. Because the die fingers 301–305 extend close to the exit point of the strip from the second rotary embossing die station 240 where the strip is being worked, this is a very sensitive correction and only a slight amount of up or down movement of the compensating die 280A is required to eliminate detected up or down bow. Similarly, the pointer 293 may be adjusted to change the relative horizontal position of the compensation die 280A and thus pull the strip slightly toward either the left or right side of the die rolls of the second rotary die station 240. This is a very sensitive adjustment at this location for removing any side curves detected in a strip. The correction for bow and side curve is very sensitive because it is being performed, in effect, largely at the center of the second rotary die stage where the strip is undergoing a stretching and deep drawing to form the embossments and the strip is under very substantial tension due to the pressure exerted by the first rotary die station. Finally, the twist die assembly 280B permits any detected twist in the strip to be compensated out by moving the pointer 324 which controls the position of the adjustment screw 321 and the relative twisting of the die sections 310 and 311.

While the method and apparatus of this invention have been described above in connection with a preferred embodiment, it should be apparent that numerous variations could be introduced by persons of ordinary skill in the art without departing from the principles of the invention. For example, instead of powering the lower shaft at the second rotary die station to pull the metal strip through the first and seconds rotary die stations, an arrangement of contoured rubber pulling rolls could be utilized to pull the metal strip through the first and second die stations with the strip rewound into a roll. Thereafter, the rerolled strip could be fed through a compensation die station using rubber rolls to produce sufficient tension in the strip to enable similar compensation dies to those at die station 280 to remove side curves, bows or twists in the strip. This could be done just prior to feeding the strip into the cutoff machine.

It will be appreciated that numerous different approaches could be taken to mounting the compensating dies at the third die station 280 for horizontal and vertical position adjustment. Numerous other modifications in the overall apparatus could be made by persons of skill in the metal working art without departing from the scope of this invention as claimed in the following claims.

What is claimed is:

1. In a metal slat for use in a venetian-type blind and having a pair of cord receiving transverse slots formed therethrough at respective end sections thereof, said slots defining narrowed slat material regions between each end of each slot and an associated adjacent marginal edge of said slat, the improvement comprising an embossed rib formed in said slat at each of said narrowed slat material regions, each said rib extending longitudinally on said slat and having an overall length substantially greater than the width of said slots, and a plurality of separated longitudinal rows of embossed ribs formed on said slat in a continuous in-and-out pattern of successive ribs in each row and having a substantial depth relative to the thickness of the slat.

2. The article of claim 1, wherein the individual embossed ribs in adjacent rows are offset longitudinally to a substantial degree.

3. The article of claim 1, wherein the individual embossed ribs in adjacent rows are offset by substantially one-half the length of said ribs.

4. The article of claim 1, wherein said slat is adapted for use in a mini-blind system and has a width less than about 1.5 inches and a thickness in the range of about 0.008 inch to about 0.010 inch, said cord receiving slot is at least about three-eights inch long and about one-eighth inch wide, and said embossed ribs are at least one-half inch long and have a depth of about 0.020 inch.

5. The article of claim 4, further comprising a plurality of separated longitudinal rows of embossed ribs formed on said slat in a continuous in-and-out pattern of successive ribs in each row, the individual in-and-out patterns of embossed ribs in adjacent rows being offset by substantially one-half the length of said ribs, each of said embossed ribs has a width of about one-eighth inch, a length of about 0.25 inch and a depth of about 0.015 inch.

6. The article of claim 5, wherein said slat is painted prior to forming said longitudinal rows of embossed ribs thereon and said embossed ribs are characterized by absence of any cuts in the slat material and absence of any substantial marring of the painted slat surface.

7. In a metal slat for use in one of a venetian-type blind system with horizontally disposed slats or a vertical slat blind system, the improvement comprising a plurality of separated longitudinal rows of embossed ribs formed on said slat in a continuous in-and-out pattern of successive ribs in each row and having a substantial depth relative to the thickness of the slat.

8. The article of claim 7, wherein the individual embossed ribs in adjacent rows are offset longitudinally to a substantial degree.

9. The article of claim 8, wherein the individual embossed ribs in adjacent rows are offset by substantially one-half the length of said ribs.

10. The article of claim 9, wherein said slat is adapted for use in a mini-blind system and has a width less than about 1.5 inches and a thickness in the range of about 0.008 to about 0.010 inch, each of said embossed ribs has a width of about one-eighth inch, a length of about 0.25 inches and a depth of about 0.015 inch.

11. The article of claim 10, wherein said slat is painted prior to forming said longitudinal rows of embossed ribs thereon and said embossed ribs are characterized by absence of any cuts in the slat material and absence of any substantial marring of the painted slat surface.

12. In apparatus for forming an embossment pattern and crown configuration on a thin narrow strip of relatively hard material wherein said embossment pattern comprises a plurality of separated longitudinal rows of embossed ribs formed on said slat in a continuous in-and-out pattern of successive ribs in each row, in combination:

a first rotary die means for prestretching of at least one localized region of a continuous flat metal strip passing therethrough; and a second rotary die means receiving said metal strip from said first rotary die means for simultaneously forming said strip into said crown configuration and forming said embossment pattern therein.

13. Apparatus as claimed in claim 12, wherein said first rotary die means comprises a first die wheel rotatably mounted on one side of said strip and having a flat circumferential surface contacting one side of said strip; a second die wheel rotatably mounted on the other side of said strip and having at least one narrow circumferential rib contacting a narrow central area of said metal strip; and means for applying pressure between said first and second die wheels; and further comprising means for driving said second rotary die means to pull said strip of material through said first and second die wheels to prestretch a central region of said strip of metal passing therebetween.

14. Apparatus as claimed in claim 13, wherein said second die wheel is mounted on a frame and said frame is pivotally mounted in a trailing fashion with a pivot axis positioned forward of the strip entry side of said first rotary die means and centered on the center line of said metal strip so that said second die wheel automatically tracks to dead center on said metal strip.

15. Apparatus as claimed in claim 12, wherein said second rotary die means comprises upper and lower die assemblies mounted on upper and lower shafts, means rotatably mounting said shafts for intermeshing of said die assemblies above and below a strip of metal passing therebetween, and intermeshed gears mounted on said shafts to produce synchronous rotation of said intermeshing die assemblies, each of said die assemblies comprising a plurality of embossment die sections and a plurality of roll forming die sections mounted together on an associated shaft with each of said embossment die sections being positioned between a pair of roll forming die sections, each of said embossment die sections having a pattern of sequential male and female die elements formed around the circumference thereof and being positioned on an associated shaft to intermesh with an associated oppositely positioned embossment die section of the opposite die assembly, the individual circumferential configuration of each of said roll forming die sections and embossment die sections being shaped to form together a composite crown-forming and embossment pattern die configuration.

16. Apparatus as claimed in claim 15, wherein the sequential male and female die elements on adjacent embossment die sections are laterally offset by substantially one-half the length of individual male and female die elements.

17. Apparatus as claimed in claim 15, wherein each of said male and female die elements has a truncated pyramidal shape with rounded corners, and the top surface of each male die elements and bottom surface of each female die element is shaped at an angle to the horizontal corresponding to the crown configuration to be formed in the strip.

18. Apparatus as claimed in claim 15, wherein said means for rotatably mounting said shafts comprises a support frame having opposite side support panels; a lower shaft mounting arrangement comprising a pair of bearing assemblies positioned at opposite ends of lower shaft means and means mounting said bearing assembly at fixed vertical positions to said side support panels and including means for adjusting the relative horizontal position of said lower shaft with respect to said side panels; and an upper shaft mounting arrangement comprising a pair of bearing assemblies positioned at opposite ends of said upper shaft, and means for mounting said bearing assemblies at vertically variable positions on said side support panels and including means for adjusting the relative horizontal position of said upper shaft with respect to said side panels; said horizontal position of said lower shaft being positioned to center the embossment pattern on said strip of metal passing between said die assemblies and said horizontal and vertical adjustment of said upper shaft enabling precise setting of the vertical and horizontal intermeshing of male and female die elements of said upper and lower die assemblies.

19. Apparatus as claimed in claim 14, further comprising first strip guide means mounted forward of said first rotary die means for guiding said flat metal strip into said first and second die wheels; a second strip guide means mounted between said first rotary die means and said second rotary die means for guiding said strip into said second rotary die means; said second rotary die means comprising upper and lower die assemblies mounted on upper and lower shafts and means rotatably mounting said shafts for intermeshing of said die assemblies above and below a strip of metal passing therebetween and intermeshed gears mounted on said shafts to produce synchronous rotation of said upper and lower die assemblies, each of said die assemblies comprising a plurality of embossment die sections and a plurality of roll forming die sections mounted together on an associated shaft with said embossment die sections positioned between successive roll forming die sections, each of said embossment die sections having a pattern of sequential male and female die elements formed around the circumference thereof and being positioned on an associated shaft to intermesh with an associated oppositely positioned embossment die section of the opposite die assembly, the individual circumferential configuration of each of said roll forming die sections and embossment die sections of each die assembly being shaped to form together a composite crown-forming and embossment pattern die configuration; said means for rotatably mounting said shafts comprising a support frame having opposite side support panels; a lower shaft mounting arrangement comprising a pair of bearing assemblies positioned at opposite ends of said lower shaft and means mounting said bearing assemblies at fixed vertical position on said side panels such that said second strip guide means guides said strip of metal into said upper and lower die assemblies at a position corresponding to the midpoint of the crowned configuration of the intermeshed upper and lower die assemblies and including means for adjusting the relative horizontal position of said lower shaft with respect to said side panels to center said embossment pattern on said strip; an upper shaft mounting arrangement comprising a pair of bearing assemblies positioned at opposite ends of said upper shaft, and means for mounting said bearing assemblies at vertically variable positions on said side support panels including means for adjusting the relative horizontal position of said upper shaft with respect to said side panels to precisely set the horizontal and vertical intermeshing of said upper and lower die assemblies.

20. Apparatus as claimed in claim 19, further comprising compensating die means receiving said crowned and embossed strip from said second rotary die means for controlling both the vertical and horizontal orientation of the path of said strip exiting said second rotary die means to remove any upward or downward bow detected in said crowned and embossed strip and any right or left side curve detected in said strip.

21. Apparatus as claimed in claim 25, further comprising twist compensating die means receiving said strip from said compensating die means for applying a controlled degree of twist to said strip to remove any detected twist therein.

22. Apparatus as claimed in claim 12, further comprising compensating die means receiving said crowned and embossed strip from said second rotary die means for controlling both the vertical and horizontal direction of the path of said strip exiting said second rotary die means to remove any upward or downward bow detected in the crowned and embossed strip and any right or left side curve detected in said crowned and embossed strip.

23. Apparatus as claimed in claim 22, further comprising twist compensating die means receiving said strip from said compensating die means for applying a controlled degree of twist to said crowned and embossed strip to remove any twist detected therein.

24. Apparatus as claimed in claim 22, wherein said compensating die means comprises a strip-holding die including a plurality of elongated die teeth arranged in a pattern of horizontally disposed upper and lower die teeth with strip contacting surfaces thereof positioned to contact marginal edge and central portions of said crowned and embossed strip at unembossed regions thereof and having an overall configuration maintaining the crowned configuration of said strip, and edge guide means confining the lateral edges of said crowned and embossed strip; and mounting means for mounting said strip-holding die behind said second rotary die means with front portions of said die teeth closely adjacent the exit point of said second rotary die means, and including first positioning means to adjust the relative horizontal position of said strip-holding die with respect to said second rotary die means to remove any right or left side curve detected in said crowned and embossed strip and second positioning means for adjusting the relative vertical position of said strip-holding die with respect to said second rotary die means to remove any up or down bow detected in said crowned and embossed strip.

25. Apparatus as claimed in claim 24, wherein said strip-holding die is mounted on a frame and said first and second positioning means control the relative horizontal and vertical positions of said frame; and further comprising a twist compensation die carried on said frame, said twist compensation die including right and left half strip receiving die elements having opposing upper and lower die teeth contacting flat regions of said crowned strip for generally maintaining said crowned configuration thereof, mounting means for separately mounting said right and left half strip receiving dies for separate rotation about an axis transverse to and generally intersecting a strip passing through said die elements, and means for setting the respective rotary positions of said right and left half die elements relative to each other to apply a controlled degree and orientation of twist to said strip to remove any detected twist therein.

26. In a machine for forming a slat for use in venetian-type blinds and having a pair of cord receiving transverse slots formed therein at respective end sections thereof, said slots defining narrowed slat material regions between each end of each slot and an associated adjacent marginal edge of said slat, an embossed rib formed in said slat at each of said narrowed slat material regions, and a plurality of separated longitudinal rows of embossed ribs formed on said slat in a continuous in-and-out pattern of successive ribs in each roll, in combination: a first machine stage for forming said embossment pattern and crowned configuration on a continuous strip of metal; a second machine stage for receiving said patterned and crowned strip for forming said slots and said embossed ribs adjacent thereto cutting said continuous strip into preselected slat lengths; and an interface stage for controllably feeding said patterned and crowned strip from said first machine stage into said second machine stage; said first machine stage comprising a first rotary die means for prestretching of at least one localized region of a continuous flat metal strip passing therethrough; a second rotary die means receiving said metal strip from said first rotary die means for simultaneously forming said strip into said crowned configuration and forming said embossment pattern therein, and including drive means powering said second rotary die means for pulling said metal strip through said first rotary die means; and third die means receiving said crowned and embossed strip from said second rotary die means for removing any detected bow, side curve or twist in said crowned and embossed strip, said crowned and embossed strip being pushed through said third die means by said second rotary die means; said second machine stage includes a pair of punch die means, each including a male and female die element for simultaneously forming one of said slots in said strip and said embossed ribs associated therewith.

27. Apparatus as claimed in claim 26, wherein said first machine stage has a strip entry end forward of said first rotary die station and a strip supply assembly feeding a continuous flat metal strip into said strip entry end from a supply roll, and a strip exit end following said third die means; said interface stage includes upper and lower strip guide track assemblies, strip turnaround guide assembly mounted for back and forth movement on said strip guide track assembly for guiding a strip between said upper and lower guide tracks; and spring tensioning means for urging said turnaround guide track assembly toward said strip exit end of said first machine stage; said lower strip guide assembly receiving said crowned and embossed strip from said first machine stage, said upper strip guide track carrying said strip across the top of said first machine stage into said second machine stage; said spring tension means having a tension force set to oppose the forces created on said strip turnaround assembly by said strip passing therethrough.

28. In a method for producing a crowned and patterned metal slat, the steps of:

passing a continuous strip of metal from a supply roll successively through a pair of rotary die stations and a compensating die station; forming at a first one of said rotary die stations a controlled prestretching of at least one narrow central portion of said strip of metal;

simultaneously forming at a second one of said rotary die stations a crowned cross-sectional configuration in said strip and a plurality of separated longitudinal rows of embossed ribs having an in-and-out pattern of successive ribs; and compensating any detected side curve, bow, or twist out of said crowned and embossed strip at said compensating die station.

29. The method of claim 28, wherein said step of passing said strip of metal through said die stations includes the step of pulling said strip through said first rotary die station using powered embossing and crown-forming die assemblies at said second rotary die station and pushing said strip through said compensating die station following said second rotary die station; and said step of forming a controlled prestretching of said strip comprises pressing on a narrow central region of said strip as it is pulled with substantial tension through said first rotary die station.

30. The method of claim 29, further comprising the steps of guiding said strip between said first and second die stations to direct said strips straight into said embossing and crown-forming die assembly of said second rotary die station and said step of compensating includes altering the horizontal exit direction of said strip from said embossing and crown-forming die assembly to controllably stretch one edge of said strip when necessary to remove a detected side curve therein, altering the vertical exit direction of said strip from said embossing and crown-forming die assembly when necessary to remove any detected upward or downward bow in said strip, and controllably twisting said strip when necessary to remove any detected twist therein.

* * * * *